US006572345B2

(12) United States Patent
Seo

(10) Patent No.: US 6,572,345 B2
(45) Date of Patent: Jun. 3, 2003

(54) COMPRESSOR HAVING DISCHARGE PULSATION REDUCING STRUCTURE

(75) Inventor: Seung-don Seo, Kwangju (KR)

(73) Assignee: Samsung Kwangju Electronics Co., Ltd., Kwangju (KR)

( * ) Notice: Subject to any disclaimer, the term of this patent is extended or adjusted under 35 U.S.C. 154(b) by 126 days.

(21) Appl. No.: 09/947,133

(22) Filed: Sep. 5, 2001

(65) Prior Publication Data

US 2002/0141885 A1 Oct. 3, 2002

(30) Foreign Application Priority Data

Mar. 7, 2001 (KR) ..... 2001-11835

(51) Int. Cl.[7] ..... F04B 39/00
(52) U.S. Cl. ..... 417/312
(58) Field of Search ..... 417/312, 415, 417/902, 269, 313; 181/198, 200, 202, 403

(56) References Cited

U.S. PATENT DOCUMENTS 4,401,418 A * 8/1983 Fritchman ..... 417/312
4,730,996 A * 3/1988 Akatsuchi et al. ..... 418/15
4,881,879 A * 11/1989 Ortiz ..... 417/312
5,173,034 A * 12/1992 Riffe ..... 417/312
5,674,061 A * 10/1997 Motegi et al. ..... 418/55.1
6,176,688 B1 * 1/2001 Collings et al. ..... 417/312
6,296,457 B1 * 10/2001 Shintoku et al. ..... 417/312
6,494,690 B2 * 12/2002 Seo ..... 417/415

* cited by examiner

*Primary Examiner*—Teresa Walberg
*Assistant Examiner*—Vinod D. Patel
(74) *Attorney, Agent, or Firm*—Ladas & Parry

(57) ABSTRACT

A compressor includes a cylinder block having a refrigerant discharge chamber installed
at a cylinder head, a first discharge muffler installed at a lower part of the cylinder block, a second discharge muffler connected to a refrigerant discharge pipe and installed at a lower part of the cylinder block, a refrigerant passage connecting the refrigerant discharge chamber and the first discharge muffler, and the refrigerant passage has a greater cross-sectional area of a refrigerant suction part than the cross-sectional area of a refrigerant discharge part, and a connection pipe connecting the first discharge muffler and the second discharge muffler, the refrigerant suction part of the refrigerant passage and an inner diameter of the connection pipe have different values with predetermined proportion.

13 Claims, 6 Drawing Sheets

COMPRESSOR HAVING DISCHARGE PULSATION REDUCING STRUCTURE

BACKGROUND OF THE INVENTION

1. Field of the Invention

The present invention relates to a reciprocating type compressor and more particularly, to a compressor having a discharge pulsation reducing structure for reducing pulsation when discharging refrigerant.

2. Description of the Prior Art

Generally, compressors are widely used for compressing refrigerant in refrigerating apparatus, such as refrigerators.

As shown in FIG. 1, general reciprocating type compressors comprise a casing 10 having an upper shell 11 and a lower shell 12, a compressing part composed of components, which are placed at a lower part of inside of the case 10 for compressing refrigerant, and a motoring part 20 for driving the compressing part.

The motoring part includes a stator 21, a rotator 22 that is rotated by the electronic interaction with the stator 21, and a crankshaft 23 press-fit in the center of the rotator 22.

The compressing part includes a cylinder block 30 installed at the lower part of the inside of the case 10, a connecting rod 40 eccentrically connected to a lower part of the crankshaft 23, a piston 50 connected to a front end of the connecting rod 40, reciprocating linearly inside of a compressive chamber 31 formed in the cylinder block 30, and a cylinder head 60 disposed at the front (32; refer to FIG. 2) of the cylinder block 30 to seal the compressive chamber 31. In the cylinder head 60, a refrigerant suction chamber 61 and a refrigerant discharge chamber 62 are separately formed up and down respectively. A valve assembly 70 is installed between the cylinder head 60 and the front 32 of the cylinder block 30. The valve assembly 70 controls flow of the refrigerant in the refrigerant suction chamber 61, the refrigerant discharge chamber 62, and the compressive chamber 31.

Meanwhile, a suction muffler 80 connected to the refrigerant suction chamber 61 is disposed at an upper of the cylinder head 60. A refrigerant suction pipe 81 that draws refrigerant from an evaporator (not shown) is connected to the suction muffler 80.

As shown in FIGS. 2 and 3, a discharge muffler 33 protrudes from the bottom of the cylinder block 30, and the discharge muffler 33 is sealed by a muffler cover 34. A refrigerant discharge pipe 35, a channel for supplying refrigerant to a condenser (not shown), is connected to the muffler cover 34. A refrigerant discharge hole 32*a* is formed in the front 32 of the cylinder block 30, and the refrigerant discharge hole 32*a* is connected to the discharge muffler 33 by a refrigerant passage 37.

On the other hand, the valve assembly 70 comprises a suction valve plate 71 having a suction valve 71*a* formed thereon, and a discharge valve plate 72 having a discharge valve 72*a* formed thereon. The suction valve 71*a* controls flow of refrigerant between the compressive chamber 31 and the refrigerant suction chamber 61 of the cylinder head 60. The discharge valve 72*a* controls flow of refrigerant between the compressive chamber 31 and the refrigerant discharge chamber 62 of the cylinder head 60.

In the above construction, a process of discharge of refrigerant drawn into the compressor after being compressed by the piston 50 is as follows.

Firstly, if the piston 50 retreats to a bottom dead point (to the left direction in FIG. 1) inside of the compressive chamber 31 by rotation of the crankshaft 23, refrigerant of low temperature and low pressure is drawn from an evaporator into the suction pipe 81. The refrigerant is drawn into the compressive chamber 31 after passing the suction muffler 80 and the refrigerant suction chamber 61 of the cylinder head 60, sequentially. Then, as the piston 50 progresses to a top dead point (to the right direction in FIG. 1) in the compressive chamber 31 rotation of the crankshaft 23, refrigerant is compressed to high temperature and high pressure by the refrigerant. Such compressed refrigerant is drawn into the discharge muffler 33 via the refrigerant discharge hole 32*a* of the front plate 32 of the cylinder block 30 and the refrigerant passage 37, after staying in the refrigerant discharge chamber 62 of the cylinder head 60 for a determined time. After that, the high temperature and high pressure refrigerant is discharged to a condenser (not shown) via the refrigerant discharge pipe 35 connected to the muffler cover 34.

However, the reciprocating compressor as described above has a problem of generating discharge pulsation since refrigerant cannot be discharged consecutively because the piston 50 discharges refrigerant after drawing and compressing by doing reciprocal action in the compressive chamber 31. This discharge pulsation of refrigerant becomes a main reason of vibration and noise of the compressor. Especially, the noise of the compressor that is generated in low frequency band about 120 Hz~500 Hz of natural frequency of other components of a refrigerating apparatus increases the noise of the entire refrigerating apparatus and vibration due to resonance with other components of the refrigerating apparatus.

Increasing the flow resistance of the discharged refrigerant can reduce this kind of discharge pulsation of refrigerant. In other words, discharge pulsation of refrigerant would be reduced by decreasing the cross-sectional area of the refrigerant passage 37 between the discharge muffler 33 and the refrigerant discharge chamber 62 of the cylinder head 60 or by lengthening the length of the refrigerant passage 37. Yet, if the cross-sectional area of the refrigerant passage 37 becomes too small, the efficiency of the compressor would be reduced since refrigerant cannot flow smoothly between the refrigerant discharge chamber 62 and the discharge muffler 33. In addition, there is a limitation to the possible length of the refrigerant passage 37, since the refrigerant passage 37 is passed through the cylinder block 30.

SUMMARY OF THE INVENTION

The present invention has been made to overcome the above-mentioned problems of the related art. Accordingly, an object of the present invention is to provide a compressor that can reduce discharge pulsation without decreasing the compressing efficiency by improving refrigerant discharge structure.

The above object is accomplished by a compressor including a cylinder block having a refrigerant discharge chamber installed in a cylinder head; a first discharge muffler that is installed at a lower part of the cylinder block; a second discharge muffler installed at a lower part of the cylinder block and whereto a refrigerant discharge pipe is connected; a refrigerant passage having a greater cross-sectional area of refrigerant suction part than that of refrigerant discharge part, and the refrigerant passage connects the refrigerant discharge chamber and the first discharge muffler; a connector that connects the first discharge muffler and the second discharge muffler. Each of the cross-sectional diameter of the refrigerant suction part and an inner diameter of the connector has different sizes with predetermined proportions.

It is preferable that the cross-sectional diameter of the refrigerant suction part and the inner diameter of the connector have predetermined proportions to meet the following conditional expression.

[Conditional expression]

$$(\Phi_1):(\Phi_2)=2.0\times6.4:1.78\times2.6$$

Moreover, the relative proportion between the diameter ($\Phi_1$) and the inner diameter ($\Phi_2$) of the compressor is 6.4:1.78.

It is advisable that the relative proportion between the diameter ($\Phi_1$) and the inner diameter ($\Phi_2$) is 6.4:2.16.

It is also advisable that the relative proportion between the diameter ($\Phi_1$) the inner diameter ($\Phi_2$) is 6.0:1.78.

In addition, it is preferable that the proportion between the diameter ($\Phi_1$) and the inner diameter ($\Phi_2$) is 6.0:2.16.

In addition to the above proportions, it is preferable that the relative proportion between the diameter ($\Phi_1$) and the inner diameter ($\Phi_2$) is 6.0:2.6.

Lastly, it is advisable that the length of the refrigerant suction part ($L_2$) to the entire length of the refrigerant passage ($L_1$) is constructed with a predetermined proportion to meet the following conditional expression.

[Conditional Expression]

$(L_1):(L_2)$=45: a range between 15 to 30

Moreover, it is preferable that the relative proportion between the length ($L_1$) and the length ($L_2$) is 3:1.

In addition, it is advisable that the relative proportion between the length ($L_1$) and the length ($L_2$) is 3:2.

BRIEF DESCRIPTION OF THE DRAWINGS

Reference may now be made to the accompanying drawings for a better understanding of the present invention, both as to its described objection and feature, with the illustration showing a preferred embodiment, but being only exemplary, and in which.

DETAILED DESCRIPTION OF PREFERRED EMBODIMENT

Figure 1:
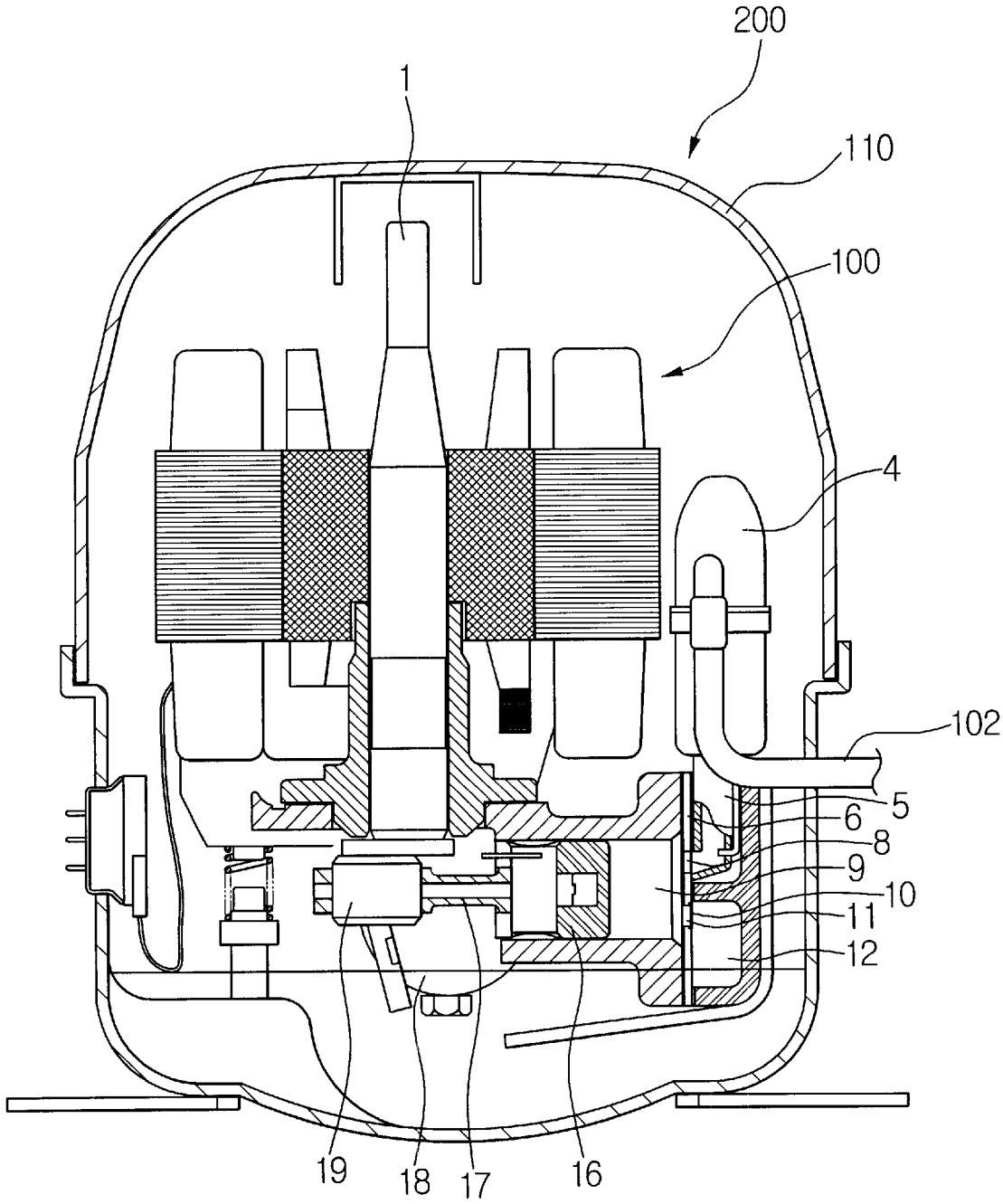
FIG. 1 is a sectional view of a conventional reciprocating type compressor.
Figure 2:
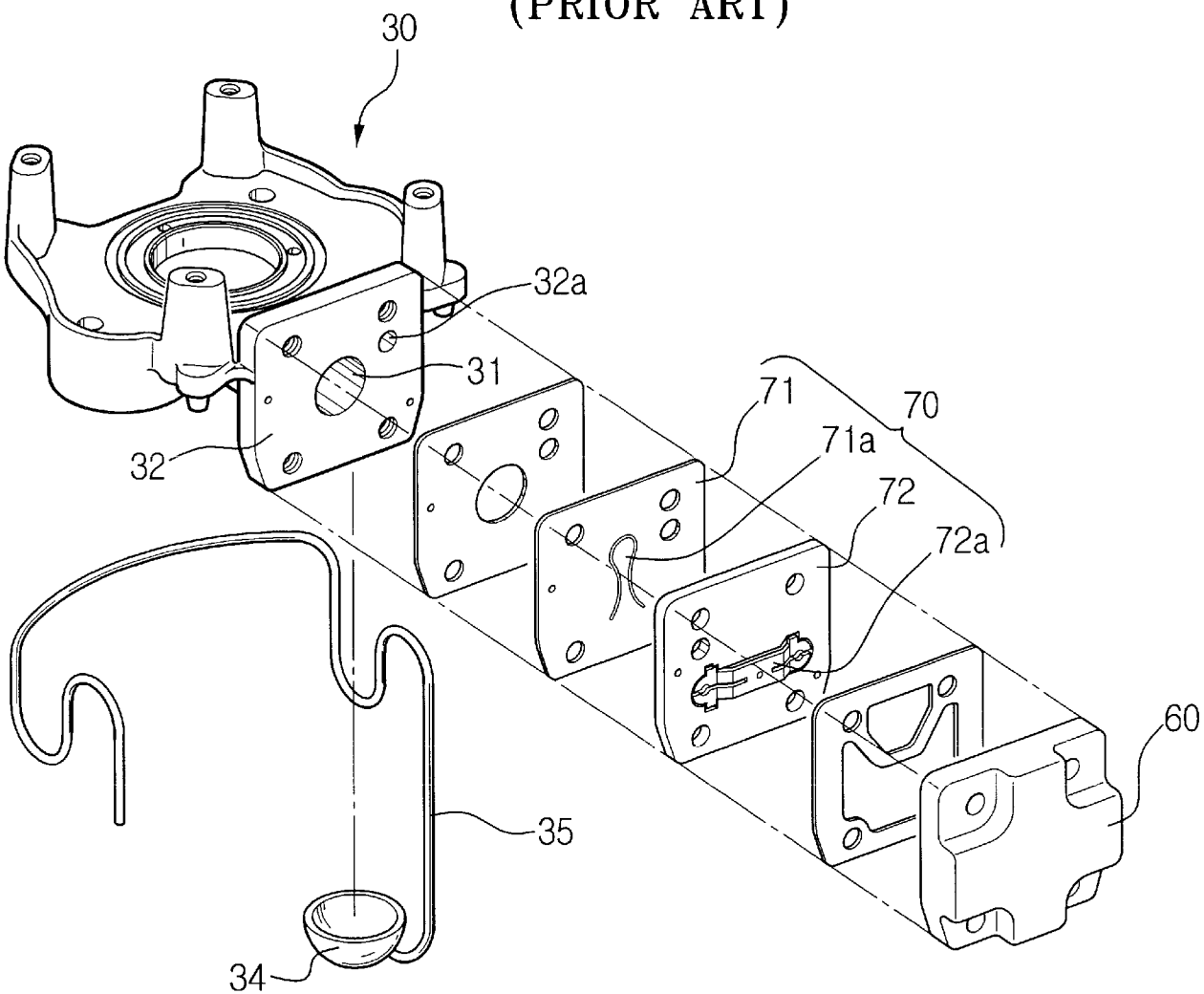
FIG.2 (PRIOR ART)
FIG. 2 is an exploded perspective view showing compressing part of the compressor of FIG. 1.
Figure 3:
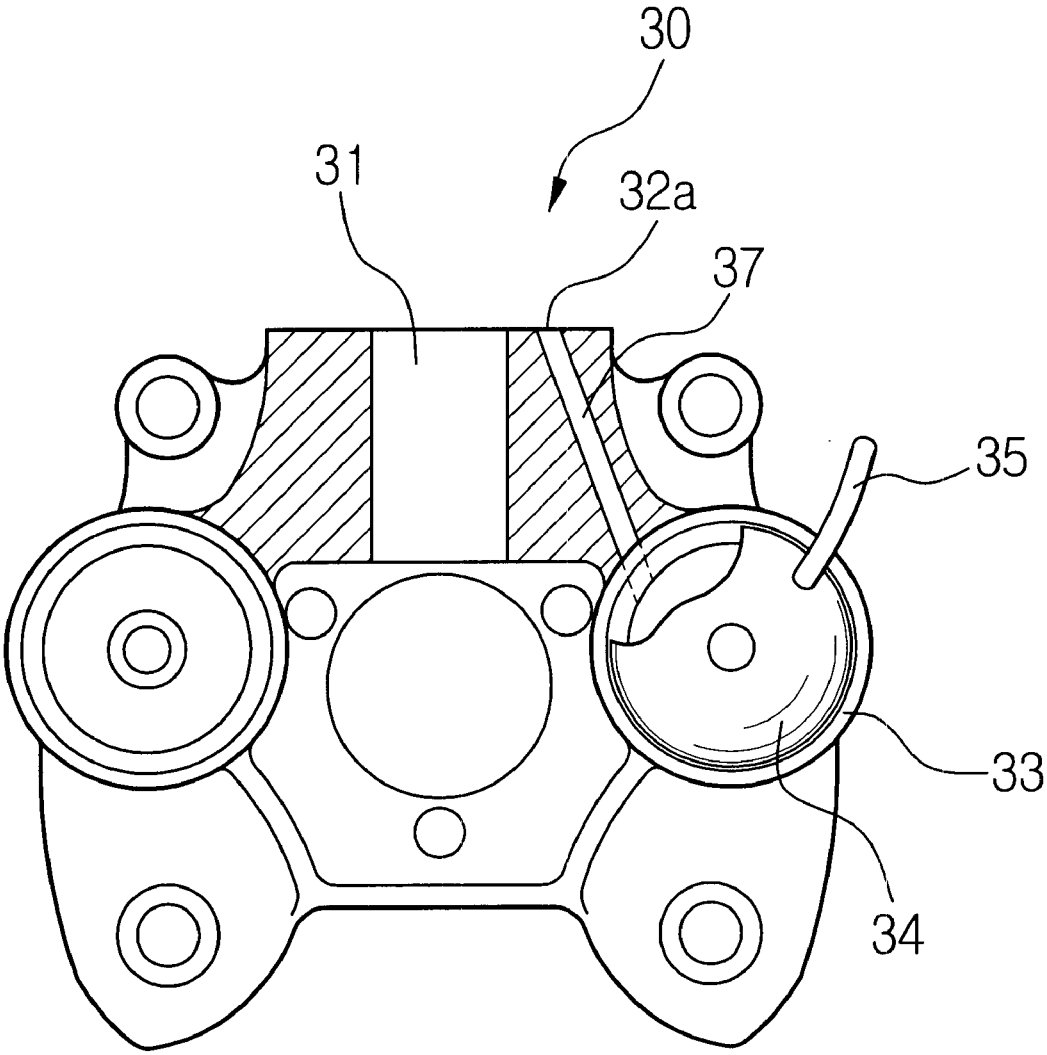
FIG.3 (PRIOR ART)
FIG. 3 is a cutaway bottom view showing the compressing part of FIG. 2.

A detailed description according to the embodiment of the present invention follows referring to the drawing figures. The compressor according to the present invention has almost the same construction as the conventional reciprocating type compressor shown in FIG. 1, thus the same reference numerals will be given to the same parts and the description of the same parts will be omitted.

Figure 4:
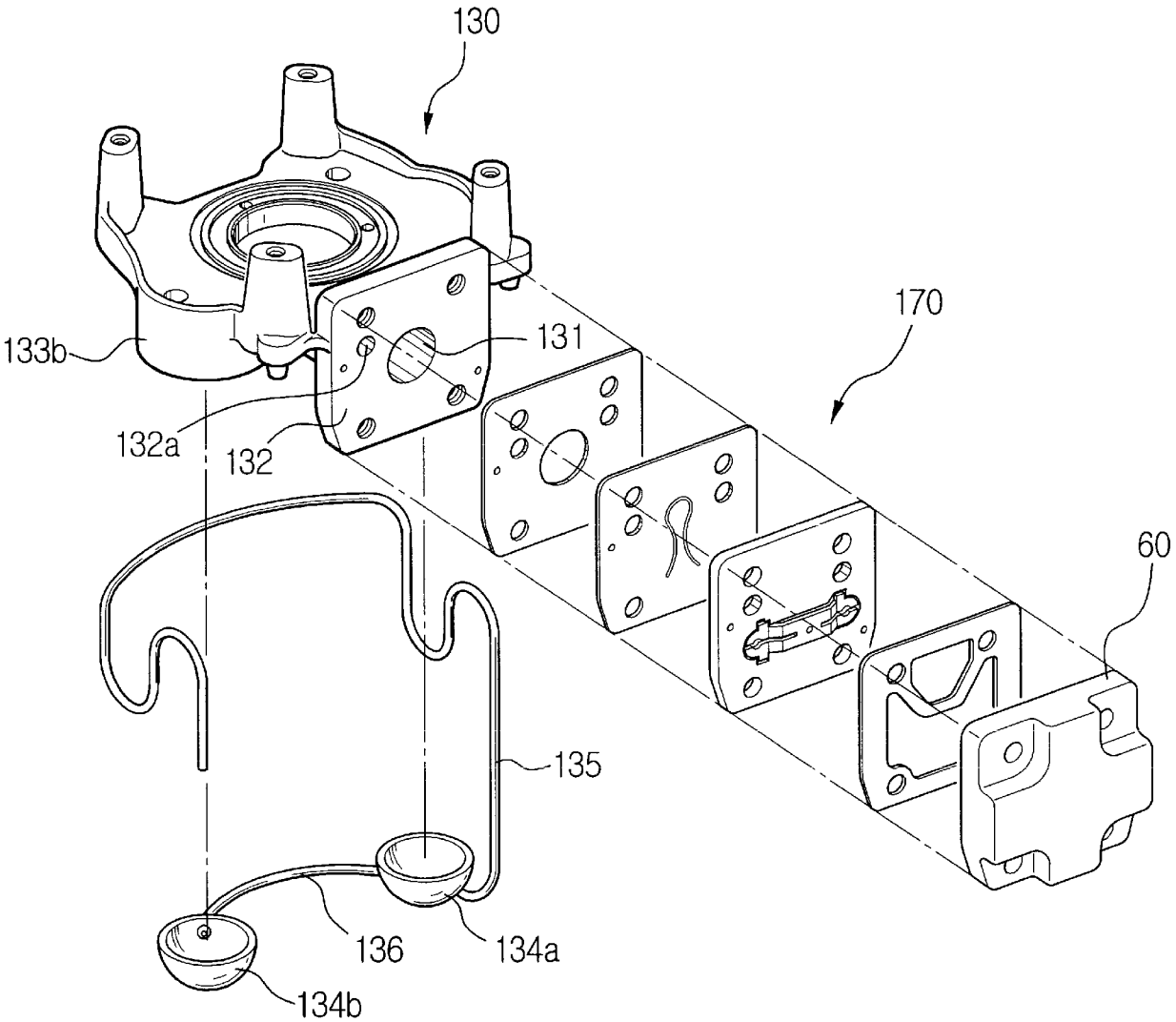
FIG. 4 is an exploded perspective view showing main portion of the compressor according to the preferred embodiment of the present invention.
Figure 5:
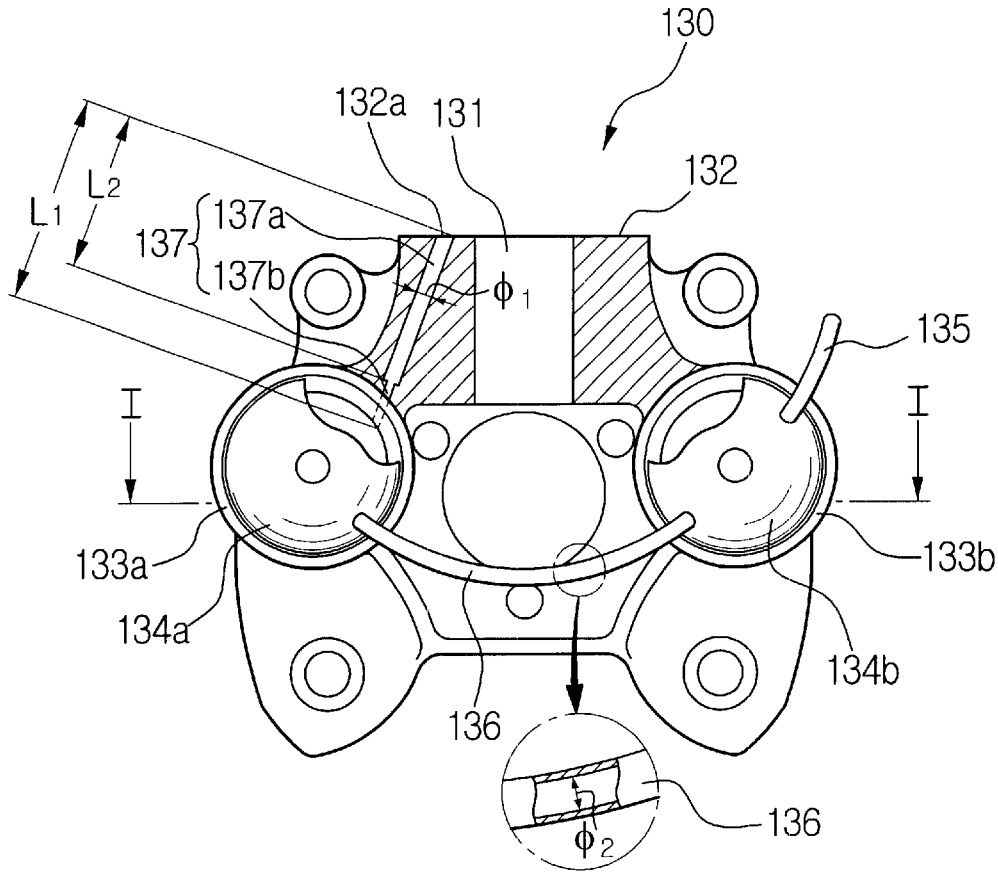
FIG. 5 is a partial sectional view of a cylinder block of FIG. 4.

As shown in FIGS. 4 and 5, the reciprocating type compressor according to the present invention comprises a cylinder block 130, a cylinder head 60 disposed at a front plate 132 of the cylinder block 130, and a valve assembly 170 installed between the cylinder block 130 and the cylinder head 60.

A refrigerant discharge hole 132*a* connected to the refrigerant discharge chamber 62 (refer to FIG. 1) of the cylinder head 60 is formed in the front plate 132 of the cylinder block 130. A first discharge muffler 133*a* and a second discharge muffler 133*b* protruded from a bottom of the cylinder block 130.

Figure 6:
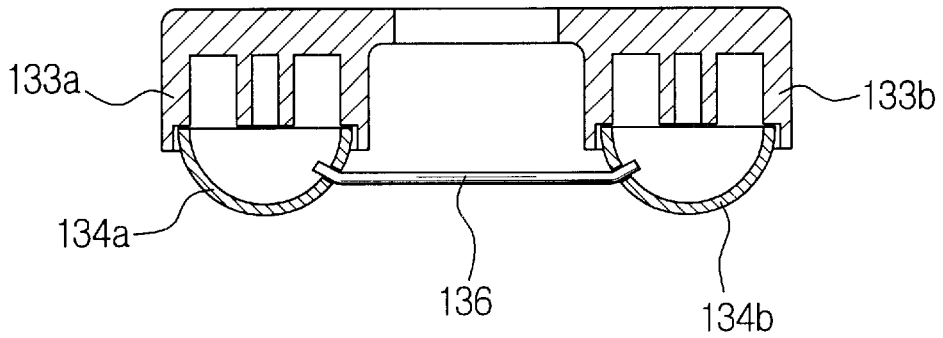
FIG. 6 is a sectional view taken on line I—I of FIG. 5.

A semi-spherical first muffler cover 134*a* and a semi-spherical second muffler cover 133*b* are disposed on each of the first discharge muffler 133*a* and the second discharge muffler 133*b*. As shown in FIGS. 4–6, a first muffler cover 134*a* and a second muffler cover 134*b* are connected by a circular connection pipe 136 having a certain curvature radius. A refrigerant discharge pipe 135 serving as a supply channel of refrigerant to a condenser (not shown) is connected to the second muffler cover 134*b*.

The refrigerant discharge hole 132*a* and the first discharge muffler 133*a* are connected with each other to permit refrigerant to flow through a refrigerant passage 137 penetrating inside of the cylinder block 130. The refrigerant passage 137 is constructed such that a refrigerant suction part 137*a* has a bigger cross-sectional area than a refrigerant discharge part 137*b*.

In the above construction, refrigerant compressed in the compressive chamber 131, flows to the refrigerant suction part 137*a* of the refrigerant passage 137 via the refrigerant discharge hole 132*a*, after staying in the refrigerant discharge chamber 62 (refer to FIG. 1) of the cylinder head 60 for a predetermined time. The discharge pulsation of the drawn refrigerant is decreased as the refrigerant flows to the refrigerant discharge part 137*b* that has a smaller cross-sectional area. Then the drawn refrigerant flows into the first discharge muffler 133*a*.

Next, the discharge pulsation of the refrigerant drawn into the first discharge muffler 133*a* is decreased again as it flows in the direction of the second discharge muffler 133*b* via the connection pipe 136. In other words, the discharge pulsation is reduced due to increase of flow resistance during the time of moving from the first discharge muffler 133*a* to the second discharge muffler 133*b* via the narrow connection pipe 136, since refrigerant flowing passage is lengthened by a predetermined length and the space is also changed.

On the other hand, it is preferable that the cross-sectional diameter ($\Phi_1$) of the refrigerant suction part 137*a* of the refrigerant passage 137 and the cross-sectional inner diameter ($\Phi_2$) of the connection pipe 136 have predetermined proportions to meet the following conditional expression.

[Conditional Expression]

$(\Phi_1):(\Phi_2)$=a range of from 2.0 to 6.4: a range of from 1.78 to 2.6

More specifically, it is advisable that the proportion of $(\Phi_1):(\Phi_2)$ is one of 6.4:1.78, 6.4:2.16, 6.0:1.78, 6.0:2.16, and 6.0:2.6.

In addition, it is recommended that the length ($L_2$) of the refrigerant suction part 137*a* to the entire length ($L_1$) of the refrigerant passage 137 is formed with a predetermined proportion to meet the following conditional expression 2.

[Conditional Expression 2]

$(L_1):(L_2)$=45: a range of from 15 to 30

More specifically, a preferable proportion of the (L1):(L2) is either 3:1 or 3:2.

According to the result of the experiment, if the diameter ($\Phi_1$) of the refrigerant suction part 137*a* of the refrigerant passage 137, the inner diameter ($\Phi_2$) of the connection pipe 136, the length (L1) of the refrigerant passage 137, and the length (L2) of the refrigerant suction part 137*a* are each formed as in Table 1 below, pulsation reducing efficiency of refrigerant will be improved without decreasing the efficiency of the compressor.

TABLE 1

| | Refrigerant passage | | Inner diameter of connection pipe |
|---|---|---|---|
| | $L_1$ [mm] | $(\Phi_1)X(L_2)$ [mmXmm] | $(\Phi_2)$ [mm] |
| 30 GRADE | 45 | 2.0 × 30 | 1.78 |
| 37–43 GRADE | | 6.4 × 30 | |
| 52–62 GRADE | | 6.0 × 15 | |
| ABOVE 72 GRADE | | 6.0 × 15 | 2.16 |

In the above table, 'GRADE ' is a specification of the compressor according to exhaust air volume. 30 GRADE and 37 GRADE mean the compressor of exhaust air volume of 3.0 cc and 3.7 cc respectively.

As shown in the above Table 1, the entire length ($L_1$) of the refrigerant passage 137 is always the same, 45 mm, regardless of the exhaust air volume of the compressor. The length ($L_2$) of the refrigerant suction part 137*a* to the entire length (L1) of the refrigerant passage 137 is formed to have 15 mm to 30 mm according to the exhaust air volume of the compressor.

More specifically, it is recommended that the length ($L_2$) of the refrigerant suction part 137*a*, the diameter ($\Phi_1$) of the refrigerant suction part 137*a*, and the inner diameter ($\Phi_2$) of the connection pipe 136 are constructed to have 15 mm, 6.0 mm and 2.16 mm, respectively, when the exhaust air volume is more than 7.2 cc. On the other hand, the length (L2) of the refrigerant suction part 137*a* has length from 15 mm to 30 mm variously when the exhaust air volume of the compressor is less than 7.2 cc. And, the diameter ($\Phi_1$) of the refrigerant suction part 137*a* has a value of 2.0 mm to 6.4 mm. In addition, it is preferable that optimal value for diameter ($\Phi_1$)×the length ($L_2$) of the refrigerant suction part 137*a* are 2.0 mm×30 mm, 6.4 mm×30 mm and 6.0×15 mm, when exhaust air volume is less than 7.2 cc. The inner diameter (101 $_2$) of the connection pipe 136 is preferably 1.78 mm or 2.16 to meet the three optimal values. It is advisable that the inner diameter ($\Phi_2$) of the connection pipe 136 is 1.78 mm when the exhaust air volume of the compressor is 3.0 cc or 3.7 to 4.3 cc, and 2.16 mm for the exhaust air volume 5.2~6.2 cc. Consequently, there are three optimal values of the relative proportion of $(\Phi_1):(L_2):(\Phi_2)$ when exhaust air volume is 3.0 cc or 3.7~4.3 cc. The three optimal values are 2.0:30:1.78, 6.4:30:1.78 or 6.0:15:1.78, Moreover, the relative proportion of $(\Phi_1):(L_2):(\Phi_2)$ has 2.0:30:2.16, 6.4:30:2.16 or 6.0:15:2.16 as its optimal value, when exhaust air volume of the compressor is 5.2~6.2 cc.

The relative proportion of $(\Phi_1):(L_2):(\Phi_2)$ is 6.0:15:2.6, when exhaust air volume of the compressor is more than 7.2 cc.

As described above, by lengthening inner diameter ($\Phi_2$) of the connection pipe 136 for the compressor having a considerable amount of exhaust air volume, the efficiency deterioration of the compressor can be prevented since only a moderate amount of refrigerant flows via the refrigerant passage 137 and the connection pipe 136.

On the other hand, the flow speed and the flow rate of refrigerant would be changeable and from the changeable feature, discharge pulsation of refrigerant would be reduced if each of the entire length ($L_1$) of the refrigerant passage 137, the length ($L_2$) of the refrigerant suction part 137*a*, the diameter ($\Phi_1$) of the same and inner diameter ($\Phi_2$) of the connection pipe 136 has different predetermined proportions as explained above.

Figure 7:
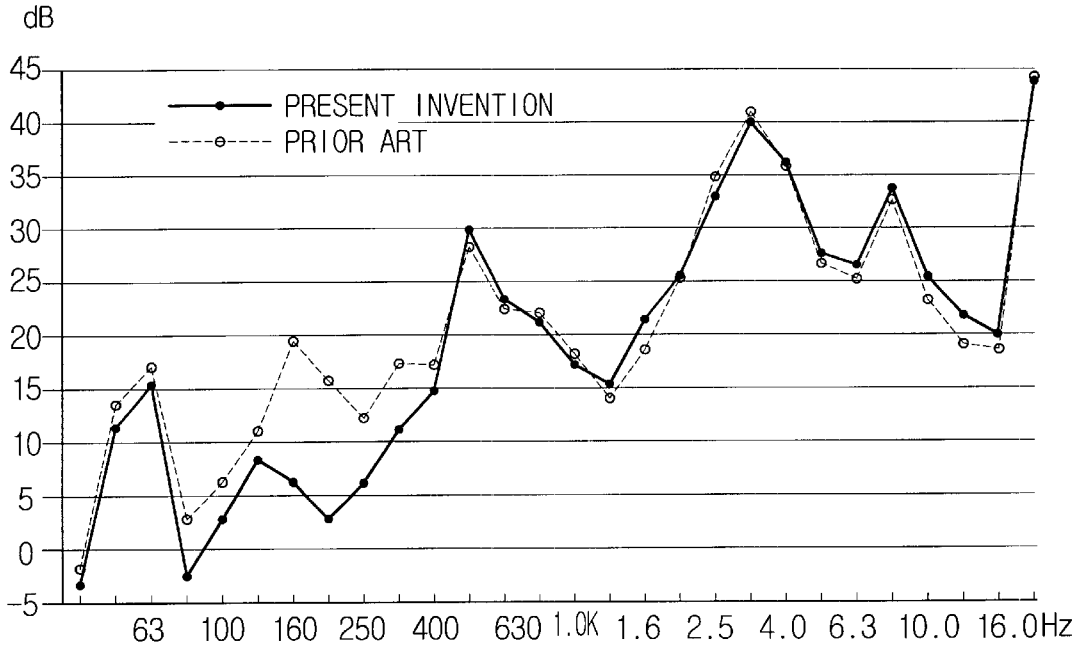
FIG. 7 is a graph showing a result of experiment of comparing the noise of a conventional compressor and compressor according to the preferred embodiment of the present invention during operation of the two compressors.

FIG. 7 is a graph showing the result of measuring and comparing the noise of the compressor according to the present invention and of the conventional compressor, after forming the refrigerant passage 137 and the connection pipe 136 according to the value of the table 1. As shown, while the conventional compressor has a high value at about 10 to 25 dB of noise generated in a low frequency band of 120 to 500 Hz that resonates with other components of refrigerating apparatus, the compressor according to the present invention has an apparently reduced value of 5 dB of noise generated in a frequency band about 120 to 500 Hz, since pulsation is reduced when refrigerant is discharged.

Accordingly, since the noise of a low frequency band can be effectively reduced, if the compressor according to the present invention is adopted to general refrigerators, kimchi refrigerators or hot and chilled water generators, the noise of the apparatus will be reduced by effectively suppressing resonance with other components in the above apparatus.

As explained above, according to the compressor of the present invention, it can reduce discharge pulsation of refrigerant without reducing the efficiency of the compressor by forming predetermined proportions with different values for each of the entire length ($L_1$) of the refrigerant passage 137, the length ($L_2$) of the refrigerant suction part 137*a*, the diameter ($\Phi_1$) of the cross-sectional area of the refrigerant suction part 137*a*, and the inner diameter ($\Phi_2$) of the connection pipe 136. Accordingly, the noise and the vibration of the compressor would be reduced as discharge pulsation of refrigerant is reduced. Especially, the present invention provides an effect of reducing the noise of the entire refrigerator since the noise is reduced in the low frequent band.

Until now, preferable embodiments of the present invention have been shown and described. However, the present invention is not limited to the above embodiments and a person skilled in the art can variously modify the present invention without deviating from the main points claimed below.

What is claimed is:

1. A compressor comprising:

a cylinder block having a refrigerant discharge chamber formed at a cylinder head;

a first discharge muffler installed at a lower part of the cylinder block;

a second discharge muffler connected to a refrigerant discharge pipe and formed at a lower part of the cylinder block;

a refrigerant passage connecting the refrigerant discharge chamber and the first discharge muffler, the refrigerant passage having a greater cross-sectional area of a refrigerant suction part than the sectional area of a refrigerant discharge part; and a connection pipe connecting the first discharge muffler and the second discharge muffler, the refrigerant suction part of the refrigerant passage having a cross-sectional diameter greater than the inner diameter of the connection pipe.

2. The compressor of claim 1 wherein the cross-sectional diameter ($\Phi_1$) of the refrigerant suction part and the inner diameter ($\Phi_2$) of the refrigerant passage have a predetermined proportion to meet the following conditional expression:

[Conditional Expression]

$$(\Phi_1):(\Phi_2)=2.0 \text{ to } 6.4:1.78 \text{ to } 2.6$$

3. The compressor of claim 2 wherein a relative proportion of the cross-sectional diameter ($\Phi_1$) and the inner diameter ($\Phi_2$) is 6.4:1.78.

4. The compressor of claim 2 wherein a relative proportion of the cross-sectional diameter ($\Phi_1$) and the inner diameter ($\Phi_2$) is 6.4:2.16.

5. The compressor of claim 2 wherein a relative proportion of the cross-sectional diameter ($\Phi_1$) and the inner diameter ($\Phi_2$) is 6.0:1.78.

6. The compressor of claim 2 wherein a relative proportion of the cross-sectional diameter ($\Phi_1$) and the inner diameter ($\Phi_2$) is 6.0:2.16.

7. The compressor of claim 2 wherein a relative proportion of the cross-sectional diameter ($\Phi_1$) and the inner diameter ($\Phi_2$) is 6.0:2.6.

8. The compressor of claim 2 wherein the length ($L_2$) of the refrigerant suction part to the entire length ($L_1$) of the refrigerant passage is formed with a predetermined proportion to meet the following conditional expression:

[Conditional Expression]

$$(L_1):(L_2)=45:15 \text{ to } 30.$$

9. The compressor of claim 8 wherein a relative proportion of the length ($L_1$) and the length ($L_2$) is 3:1.

10. The compressor of claim 8 wherein a relative proportion of the length ($L_1$) and the length ($L_2$) is 3:2.

11. The compressor of claim 1 wherein the length ($L_2$) of the refrigerant suction part to the entire length ($L_1$) of the refrigerant passage is formed with a predetermined proportion to meet the following conditional expression:

[Conditional Expression]

$$(L_1):(L_2)=45:15 \text{ to } 30.$$

12. The compressor of claim 11 wherein a relative proportion of the length ($L_1$) and the length ($L_2$) is 3:1.

13. The compressor of claim 11 wherein a relative proportion of the length ($L_1$) and the length ($L_2$) is 3:2.

* * * * *